US006427758B1

(12) United States Patent
Klassen

(10) Patent No.: US 6,427,758 B1
(45) Date of Patent: Aug. 6, 2002

(54) STRAND PULLING-OFF METHOD AND CURVED CONTINUOUS CASTING PLANT FOR CARRYING OUT THE METHOD

(75) Inventor: Hans Esau Klassen, Willich (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/377,352

(22) Filed: Aug. 19, 1999

(30) Foreign Application Priority Data

Aug. 26, 1998 (DE) ..... 198 38 774

(51) Int. Cl.[7] ..... B22D 11/20; B22D 2/00

(52) U.S. Cl. ..... 164/454; 164/150.1; 164/413; 164/484

(58) Field of Search ..... 164/454, 413, 164/150.1, 484, 442, 155.1

(56) References Cited

U.S. PATENT DOCUMENTS 3,344,841 A * 10/1967 Rys ..... 164/150
3,478,808 A * 11/1969 Adams ..... 164/4
4,588,020 A * 5/1986 Waltl et al. ..... 164/454
4,949,777 A * 8/1990 Itoyama et al. ..... 164/453
5,350,009 A * 9/1994 Mizoguchi et al. ..... 164/454

* cited by examiner

*Primary Examiner*—M. Alexandra Elve
*Assistant Examiner*—Len Tran
(74) *Attorney, Agent, or Firm*—Friedrich Kueffner

(57) ABSTRACT

A strand pulling-off method for a metal strip cast in a curved continuous casting plant and a curved continuous casting plant, wherein the metal strip is initially pulled vertically from a casting mold using a curved entry segment driven with an entry speed. A curved shape is imparted to the metal strip in the curved entry segment such that the metal strip travels in a circular arc. The metal strip is straightened after reaching a horizontal strip travel direction using a curved exit segment driven with an exit speed and conveying the metal strip out of the curved exit segment. The metal strip is guided between the curved entry segment and the curved exit segment initially over a reaction roller arranged at the circular arc and then over a guide roller underneath the circular arc and it is detected whether the metal strip is in contact with the guide roller or the metal strip is lifted off from the guide roller, wherein the exit speed is increased when the metal strip is in contact with the guide roller and the exit speed is decreased when the metal strip is lifted off from the guide roller.

6 Claims, 1 Drawing Sheet

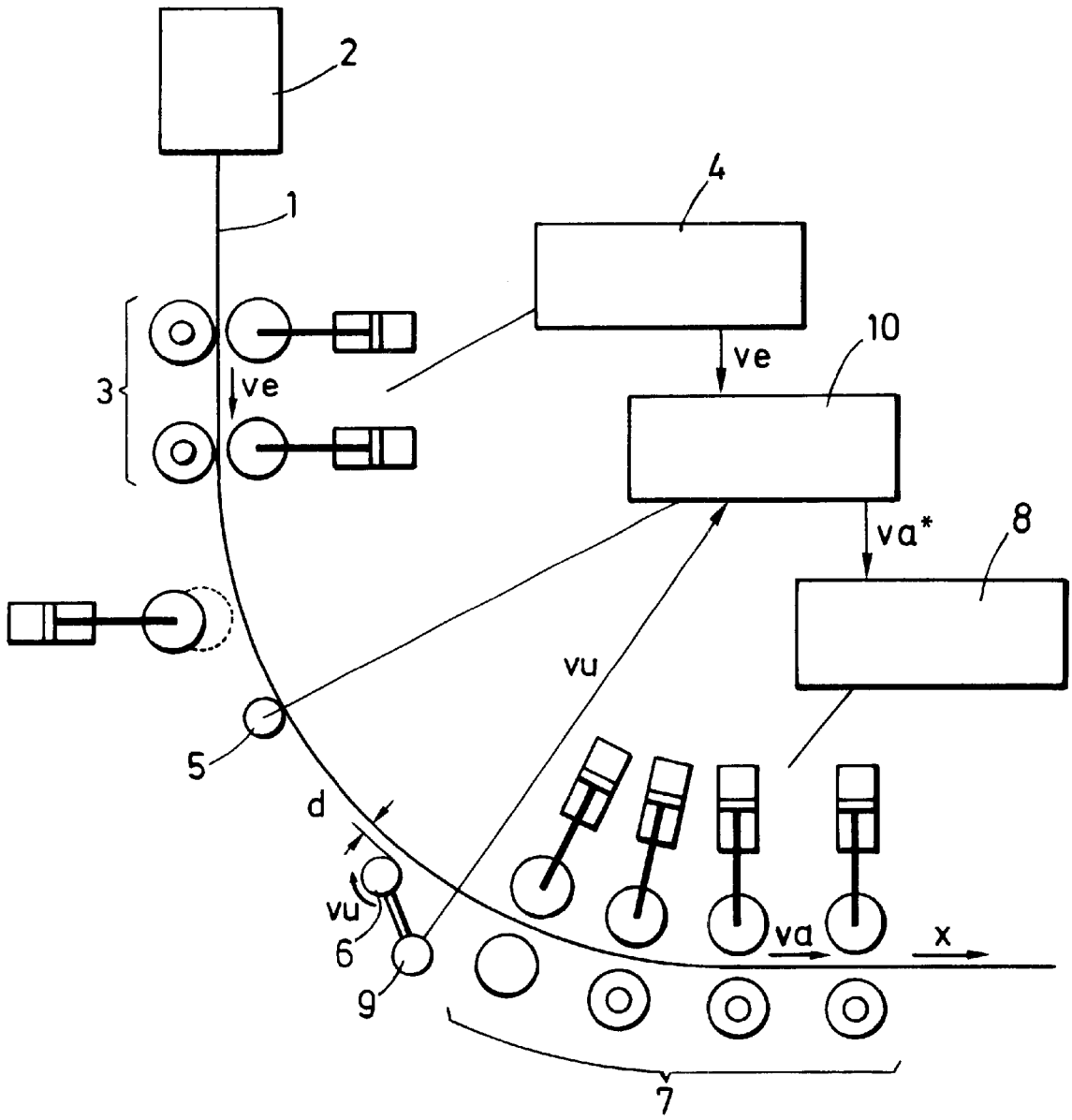
2
1
4
10
ve
3
ve
va*
8
vu
5
d
vu
6
9
va
x
7

STRAND PULLING-OFF METHOD AND CURVED CONTINUOUS CASTING PLANT FOR CARRYING OUT THE METHOD

BACKGROUND OF THE INVENTION

1. Field of the Invention

The present invention relates to a strand pulling-off method for a metal strip, particularly a steel strip, cast in a curved continuous casting plant, wherein the metal strip is initially pulled vertically from a casting mold by a curved entry segment driven at an entry speed, wherein a curved shape is imparted on the metal strip in the curved entry segment so that the metal strip travels in a circular arc, wherein the metal strip, after reaching a horizontal strip travel direction, is straightened by a curved exit segment driven at an exit speed and the metal strip is conveyed out of the curved exit segment, and wherein the metal strip is guided between the curved entry segment and the curved exit segment initially over a reaction roller arranged at the circular arc and then over a guide roller.

The present invention also relates to a curved continuous casting plant for carrying out the method.

2. Description of the Related Art

A strand pulling-off method and a curved continuous casting plant of the above-described type are sold, for example, by SMS Schloemann-Siemag Aktiengesellschaft as so-called CSP plants. Thin slabs having a strip thickness of between 40 mm and 150 mm are cast in such CSP plants.

In curved continuous casting plants, the metal strip is pulled vertically from a casting mold. Subsequently, a curved shape is imparted on the metal strip by a driven curved entry segment or bending driver. After reaching a horizontal strip travel direction, the metal strip is straightened by a driven curved exit segment or pulling-out straightening drive.

In the ideal case, the metal strip extends along an exact circular arc between the two drivers. Among other things, this requires that the two drivers act with exactly the same speed on the metal strip. Differences in the speeds have the result that the metal strip either extends in the shape of a chord between the two drivers or the metal strand sags through. Sagging through of the metal strip can be mechanically counteracted by placing a reaction roller and an additional guide roller against the metal strip from below.

Deviations of the metal strip from its ideal line may result in operating problems and may even lead to interruptions of the casting operation. Accordingly, it is necessary that speed differences are controlled immediately in order to avoid as much as possible any deviations of the metal strip from its ideal line. Moreover, the metal strip should roll with firm contact on at least one roller arranged at the circular arc, so that the stability of the overall travel of the metal strip and, thus, of the entire curved continuous casting plant is increased and the travel is more uniform.

SUMMARY OF THE INVENTION

Therefore, it is the primary object of the present invention to provide a strand pulling-off method and a curved continuous casting plant for carrying out the method which make it possible to guide the metal strip with sufficient accuracy on its ideal line and to safely detect any deviations from the ideal line in time for being able to counteract the deviations.

In accordance with the present invention, the guide roller is arranged underneath the circular arc. The method provides for detecting whether the metal strip is in contact with the guide roller or whether the metal strip has lifted off from the guide roller, and the exit speed is raised when the metal strip is in contact with the guide roller and the exit speed is lowered when the metal strip lifts off from the guide roller.

The curved continuous casting plant according to the present invention meets the above object by arranging the guide roller underneath the circular arc and by providing the guide roller with a monitoring device which detects whether the metal strip is in contact with the guide roller or whether the metal strip has lifted off from the guide roller and the monitoring device is in operative connection with a control element which is capable of controlling the exit drive depending on whether the metal strip is in contact with the guide roller or whether the metal strip has lifted off from the guide roller.

Accordingly, when carrying out the strand pulling-off method according to the present invention or when using the curved continuous casting plant according to the present invention, the metal strip is allowed to sag through in a defined manner within a tolerance range. This slight sagging of the metal strip does not have an influence either on the casting process or on the quality of the produced metal strip. However, the decisive advantage achieved with the present invention is that when the exit speed is too high, i.e., when the metal strip has the tendency to assume the shape of a chord, the metal strip is lifted first from the guide roller and would only later lift off from the reaction roller. However, even the lifting off from the guide roller is detected so that the exit speed can be adjusted in time before the metal strip lifts off from the reaction roller.

The guide roller rotates with a circumferential speed. When the metal strip is in contact with the guide roller, the circumferential speed inevitably is the same as the entry speed. Consequently, it is possible to recognize the metal strip as being in contact with the guide roller when the difference between the circumferential speed and the entry speed drops below a predetermined speed barrier, and the metal strip is recognized as being lifted off from the guide roller when the difference between the circumferential speed and the entry speed exceeds the predetermined speed barrier.

Accordingly, the monitoring device may be constructed, for example, as a speed sensor for measuring the circumferential speed of the guide roller.

When the metal strip is in contact with the guide roller, the metal strip exerts a force on the guide roller. Consequently, it is also possible to recognize the metal strip as being in contact with the guide roller when the contact force exceeds a predetermined force barrier, and the metal strip is recognized as being lifted off from the guide roller when the contact force drops below the predetermined force barrier.

Accordingly, the monitoring device may be constructed as a contact force sensor for measuring the contact force with which the metal strip rests against the guide roller.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

BRIEF DESCRIPTION OF THE DRAWING

The single FIGURE of the drawing is a schematic illustration of a curved continuous casting plant for a metal strip.

DESCRIPTION OF THE PREFERRED EMBODIMENTS

The curved continuous casting plant illustrated in the drawing is capable of casting a metal strip 1, for example, a steel strip. The metal strip 1 has a strip thickness of between 40 mm and 150 mm. Consequently, the curved continuous casting plant shown in the drawing is a so-called thin slab casting plant.

As further illustrated in the drawing, the curved continuous casting plant includes a casting mold 2. A curved entry segment 3 is arranged underneath the casting mold 2. The curved entry segment 3 is controlled by an entry drive system 4 in such a way that it pulls the metal strip 1 with an entry speed ve vertically from the casting mold 2 and imparts a curved shape on the metal strip 1. Consequently, after leaving the curved entry segment 3, the metal strip 1 travels along a circular arc.

A reaction roller 5 is arranged underneath the curved entry segment 3. The reaction roller 5, in turn, is followed by a guide roller 6. A curved exit segment 7 is arranged following the guide roller 6. The curved exit segment 7 is driven by means of a speed-controllable exit drive system 8. The curved exit segment 7 once again straightens the metal strip 1 after reaching a horizontal strip travel direction x. Also, the curved exit segment 7 conveys the metal strip 1 with an exit speed ve out of the curved exit segment 7.

When the metal strip 1 is held by means of the curved segments 3, 7 on its ideal line, the metal strip 1 rests exactly against the reaction roller 5. Accordingly, the reaction roller 5 is arranged at the circular arc. However, when the exit speed va is greater than the entry speed ve, the metal strip 1 extends between the curved segments 3, 7 in the shape of a chord. In other words, the metal strip 1 lifts off from the reaction roller 5. While it is possible to detect and then counteract this lifting off of the metal strip 1 from the reaction roller 5, this requires complicated and fast sensor and control systems. In order to make it possible to react more quickly to deviations of the metal strip 1 from its ideal line, the present invention provides the following:

The guide roller 6 is not arranged at the circular arc, but underneath the circular arc. The distance d of the guide roller 6 from the circular arc is between 5 cm and 15 cm. The guide roller 6 additionally has a monitoring device 9. In the illustrated embodiment, the monitoring device 9 is a speed sensor. The monitoring device 9 is capable of determining the circumferential speed vu of the guide roller 6. When the difference between the circumferential speed vu and the entry speed ve drops below a predetermined speed barrier, the metal strip 1 is recognized by a control element 10 as being in contact with the guide roller 6. On the other hand, when the difference between the circumferential speed vu and the entry speed ve exceeds the predetermined speed barrier, the metal strip 1 is recognized by the control element 10 as being lifted off from the guide roller 6.

Consequently, the monitoring device 9 makes it possible to detect whether the metal strip 1 is in contact with the guide roller 6 or whether the metal strip 1 has lifted off from the guide roller 6. By providing an appropriate desired value va* to the exit drive system 8, the exit speed va can be increased when the metal strip 1 is in contact with the guide roller 6 and the exit speed va can be lowered when the metal strip 1 lifts off from the guide roller 6.

Alternatively, the monitoring device 9 may also be constructed as a contact force sensor. In that case, a contact force with which the metal strip 1 rests against the guide roller 6 or the force exerted by the metal strip 1 on the guide roller 6 is measured. The metal strip 1 is then recognized as being in contact with the guide roller 6 when the contact force exceeds a predetermined force barrier. Conversely, the metal strip is recognized as being lifted off from the guide roller 6 when the contact force drops below the predetermined force barrier.

By arranging the guide roller underneath the circular arc, it is additionally ensured that the metal strip 1 can only sag through slightly. However, since the metal strip 1 does not simultaneously but successively come into contact with the rollers 5, 6 or loose contact from the rollers 5, 6, a tolerance range is provided for the exit speed va within which the metal strip 1 does not loose contact with the reaction roller 5.

While specific embodiments of the invention have been described in detail to illustrate the inventive principles, it will be understood that the invention may be embodied otherwise without departing from such principles.

I claim:

1. A strand pulling-off method for a metal strip cast in a curved continuous casting plant, the method comprising pulling the metal strip initially vertically from a casting mold using a curved entry segment driven with an entry speed, imparting to the metal strip in the curved entry segment a curved shape such that the metal strip travels in a circular arc, straightening the metal strip after reaching a horizontal strip travel direction using a curved exit segment driven with an exit speed and conveying the metal strip out of the curved exit segment, guiding the metal strip between the curved entry segment and the curved exit segment initially over a reaction roller arranged at the circular arc and then over a guide roller underneath the circular arc, detecting whether the metal strip is in contact with the guide roller or the metal strip is lifted off from the guide roller, and increasing the exit speed when the metal strip is in contact with the guide roller and decreasing the exit speed when the metal strip is lifted off from the guide roller.

2. The method according to claim 1, wherein the guide roller rotates with a circumferential speed, recognizing the metal strip as being in contact with the guide roller when a difference between the circumferential speed and the entry speed drops below a predetermined speed barrier, and recognizing the metal strip as being lifted off from the guide roller when the difference between the circumferential speed and the entry speed exceeds the predetermined speed barrier.

3. The method according to claim 1, wherein the metal strip exerts a contact force on the guide roller, comprising recognizing the metal strip as being in contact with the guide roller when the contact force exceeds a predetermined force barrier, and recognizing the metal strip as being lifted off from the guide roller when the contact force drops below the predetermined force barrier.

4. A curved continuous casting plant for casting a metal strip, the plant comprising a casting mold, a curved entry segment arranged underneath the casting mold for vertically pulling the metal strip from the casting mold and for imparting a curved shape on the metal strip such that the metal strip travels in a circular arc when leaving the curved entry segment, a reaction roller arranged underneath the curved entry segment at the circular arc, a guide roller arranged following the reaction roller underneath the circular arc, a curved exit segment with a speed-controllable exit drive arranged following the curved exit segment for straightening the metal strip after reaching a horizontal strip travel direction and for conveying the metal strip out of the curved exit segment, wherein the guide roller comprises a monitoring device for detecting whether the metal strip is in contact with the guide roller or whether the metal strip is lifted off from the guide roller, and wherein the monitoring device is in operative connection with a control element for controlling the exit drive in dependence on whether the metal strip is in contact with the guide roller or the metal strip is lifted off from the guide roller.

5. The curved continuous casting plant according to claim 4, wherein the monitoring device is a speed sensor for measuring a circumferential speed of the guide roller.

6. The curved continuous casting plant according to claim 4, wherein the monitoring device is a contact force sensor for detecting the contact force with which the metals trip rests against the guide roller.

* * * * *